US005832738A

United States Patent [19]

Shin

[11] Patent Number: 5,832,738

[45] Date of Patent: Nov. 10, 1998

[54] REFRIGERATOR HAVING A PLURALITY OF EVAPORATORS

[75] Inventor: Jun-Chul Shin, Incheon, Rep. of Korea

[73] Assignee: Daewoo Electronics Co., Ltd., Seoul, Rep. of Korea

[21] Appl. No.: 798,822

[22] Filed: Feb. 12, 1997

[30] Foreign Application Priority Data

Jun. 4, 1996 [KR] Rep. of Korea ..... 1996-14831

[51] Int. Cl.[6] ..... F25D 21/06

[52] U.S. Cl. ..... 62/276; 62/524; 165/125

[58] Field of Search ..... 62/276, 80, 151, 62/152, 177, 180, 272, 408, 404, 413, 440, 515, 524, 525, 526; 165/125

[56] References Cited

U.S. PATENT DOCUMENTS

| | | | |
|---|---|---|---|
| 2,001,832 | 5/1935 | Bandurski | 165/125 |
| 2,044,832 | 6/1936 | Child | 165/125 |
| 2,062,054 | 11/1936 | Huggins | 62/199 |
| 2,155,484 | 4/1939 | Gottlieb | 62/199 |
| 2,239,190 | 4/1941 | Chambers | 62/524 |
| 2,353,804 | 7/1944 | Baker et al. | 62/524 |
| 2,495,351 | 1/1950 | Smith | 165/125 |
| 3,247,678 | 4/1966 | Mohlman | 62/199 |
| 3,866,439 | 2/1975 | Bussjager et al. | 62/504 |
| 5,031,413 | 7/1991 | Tsuihiji et al. | 62/199 |

FOREIGN PATENT DOCUMENTS

| | | | |
|---|---|---|---|
| 128108 | 12/1984 | European Pat. Off. | 62/276 |
| 2209823 | 5/1989 | United Kingdom | 62/152 |

*Primary Examiner*—William Doerrler
*Attorney, Agent, or Firm*—Jacobson, Price, Holman & Stern, PLLC

[57] ABSTRACT

A cooling apparatus for use in a cooling system. The cooling apparatus has many evaporators disposed transversely to a longitudinal direction of a cool air duct. The refrigerant is supplied respectively to the evaporators by a valve device. Each evaporator has a conductive pipe which is wound spirally. Many blowers are disposed to each of the evaporators respectively. The diameter of wound part of the conductive pipe increases gradually along the circulating direction of the cool air, so the evaporators substantially have cone-shapes. Many defrosting heaters are disposed coaxially with the conductive pipes respectively. Since the evaporators are controlled respectively, at least one evaporator is operated during the defrosting operation of other evaporators, so the cooling efficiency is increased. Also, the heat exchange is performed uniformly on the entire areas of the evaporators by the spirally wound conductive pipes, the cooling apparatus has high efficiency of cooling.

8 Claims, 5 Drawing Sheets

REFRIGERATOR HAVING A PLURALITY OF EVAPORATORS

BACKGROUND OF THE INVENTION

1. Field of the Invention

The present invention relates to a refrigerator, and more particularly to a refrigerator having a plurality of evaporators which are controlled respectively.

2. Prior Art

In general, like a refrigerator has an evaporator for generating cool air. Such a conventional refrigerator is shown in FIG. 1. The refrigerator has a freezing compartment 1 and a fresh food compartment 2 which are separated from each other by a partitioning wall 3. An evaporator 4 is disposed in a cool air duct 7 which is in a back wall of the freezing compartment 1, and a compressor 6 is installed in the lower rear part of the refrigerator. A condenser (not shown) is disposed between the compressor 6 and the evaporator 4. The compressor 6 compresses refrigerant into gas having high pressure and high temperature, and the condenser condenses the gas into liquid by radiating heat from the gaseous state refrigerant. The liquid state refrigerant is supplied into the evaporator 4, and the evaporator 4 generates cool air by evaporating the refrigerant.

A blowing fan 5 is disposed on the upper side of the evaporator 4. The blowing fan 5 blows the cool air generated in the evaporator 4 into the freezing compartment 1. Accordingly, the foods in the freezing compartment 1 are frozen. Part of the cool air from the evaporator 4 is supplied into the fresh food compartment 2 through a refrigerating duct 8 disposed behind the cool air duct 7.

A defrosting heater 9 is disposed on the lower side of the evaporator 4. The defrosting heater 9 functions to defrost the evaporator 4 by providing heat thereto. When the amount of the frost generated on the evaporator 4 becomes larger than a predetermined amount as the cooling operation of the evaporator 4 continues, the compressor 6 stops operating and the defrosting heater 9 begins defrosting operation.

FIG. 2 is an enlarged view of the evaporator 4 in FIG. 1. The evaporator 4 has a conductive pipe 4*b* which is zigzag-shaped by being bent several times, and a plurality of heat exchange plates 4*a* which are disposed parallel with each other. The refrigerant supplied in the conductive pipe 4*b* evaporates in the conductive pipe 4*b* so as to absorb heat from the ambient air, and accordingly the cool air is generated around the evaporator 4. The plates 4*a* function to enhance the efficiency of heat exchange by enlarging the area which is in contact with the ambient air. The plates 4*a* are disposed parallel so that the longitudinal directions of the spaces formed thereby are in accordance with the circulating direction of the cool air formed by the blowing fan 5.

However, such a conventional refrigerator has the problem that the cooling efficiency thereof is low since the cooling operation is not performed during the defrosting operation for eliminating the frost on the evaporator 4. Furthermore, since the amount of heat exchange differs at each part of the evaporator 4, the efficiency of heat exchange is low. That is, the air which is forcedly circulated by the blowing fan 5 comes in contact with the lower part of the evaporator 4, and then the cooled air comes in contact with the upper part of the evaporator 4. Accordingly, the amount of heat exchange is smaller at the upper part of the evaporator 4 than that at the lower part of the evaporator 4. Also, since the frost is not generated uniformly at each part of the evaporator 4 but generated much more at the lower part of the evaporator 4 which has a larger amount of heat exchange, the period for the defrosting operation is shortened and accordingly the cooling efficiency of the refrigerator becomes low.

SUMMARY OF THE INVENTION

The present invention has been proposed to overcome the above described problems in the prior art, and accordingly it is an object of the present invention to provide a refrigerator which performs cooling operation while the defrosting operation is performed, and accordingly has high efficiency of cooling.

Also it is another object of the present invention to provide a refrigerator having a cooling apparatus which performs heat exchange uniformly on the overall area of the evaporator.

To achieve the above object, the present invention provides a refrigerator having a cooling apparatus having a cool air duct disposed in a wall of a cooling compartment and being communicated with the cooling compartment, the cooling apparatus comprising: a plurality of evaporators disposed transversely to a longitudinal direction of the cool air duct therein for generating cool air; a means for controlling a supply of refrigerant to the evaporators respectively; and a plurality of blowers for blowing toward the evaporators respectively to provide the cooling compartment with the cool air.

It is preferable that the evaporators have conductive pipes respectively which are wound spirally along the longitudinal direction of the cool air duct.

The above another object is achieved by the cooling apparatus in which a diameter of wound part of the conductive pipes increases gradually along a blowing direction of the blowers.

Also, if the evaporators further comprise a plurality of fins for exchanging heat which are mounted on outer surfaces of the conductive pipes, the amount of heat exchange is increased more.

Furthermore, it is more preferable that the evaporator have a plurality of heaters for defrosting the evaporators respectively.

It is even more preferable to dispose a plurality of walls for partitioning the evaporators to enhance the efficiency of cooling.

Also, it is possible that the controlling means is controlled to alternatively supply the evaporators with the refrigerant.

Furthermore, by disposing the evaporators in an area adjacent to cool air discharging ports of the cool air duct, it is possible to provide the cool air uniformly into the cooling compartment.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, an embodiment according to the present invention will be described in detail with reference to the drawings.

Figure 1:
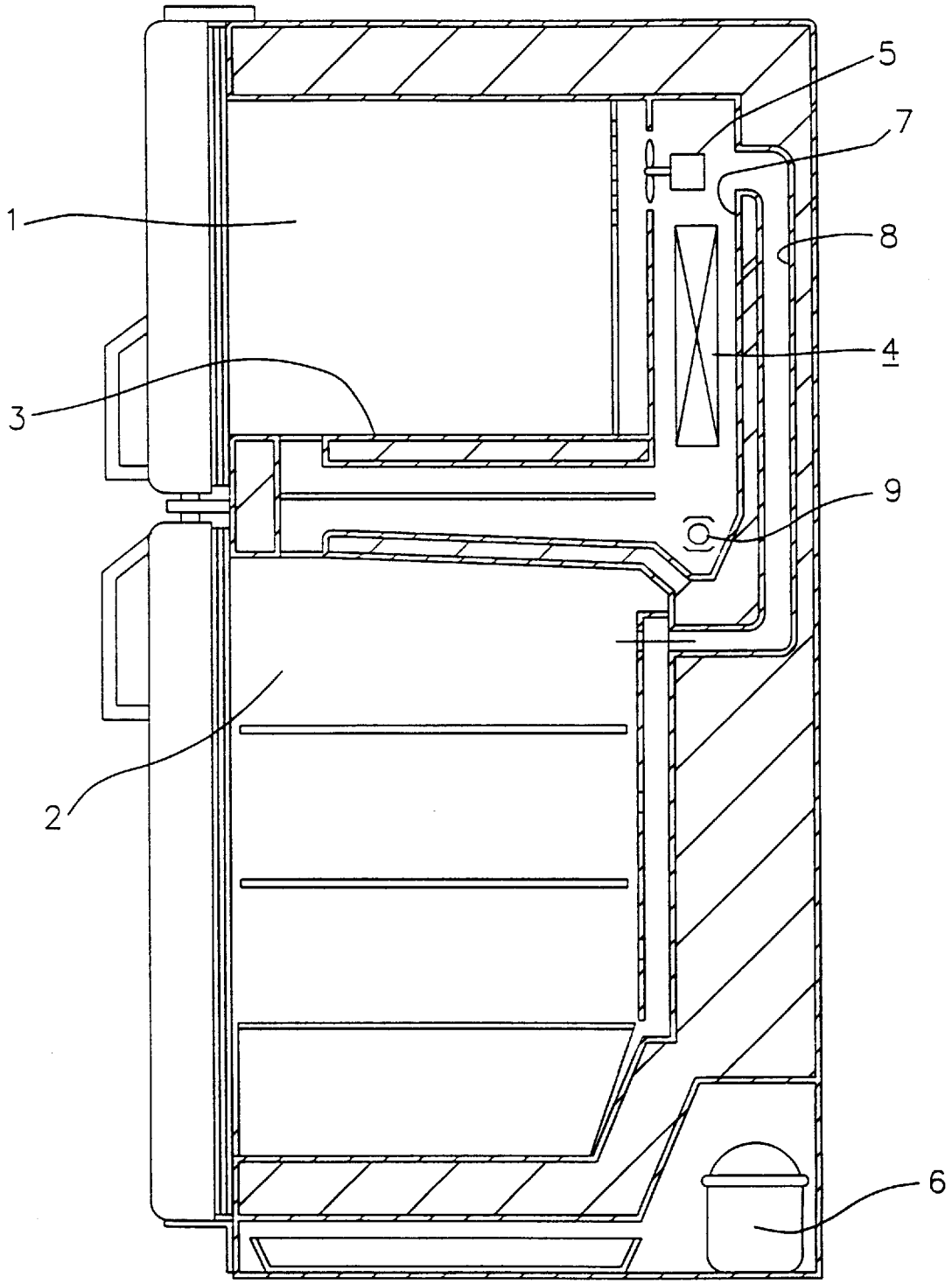
FIG. 1 PRIOR ART
FIG. 1 is a side sectional view of a refrigerator with a conventional cooling apparatus.
Figure 2:
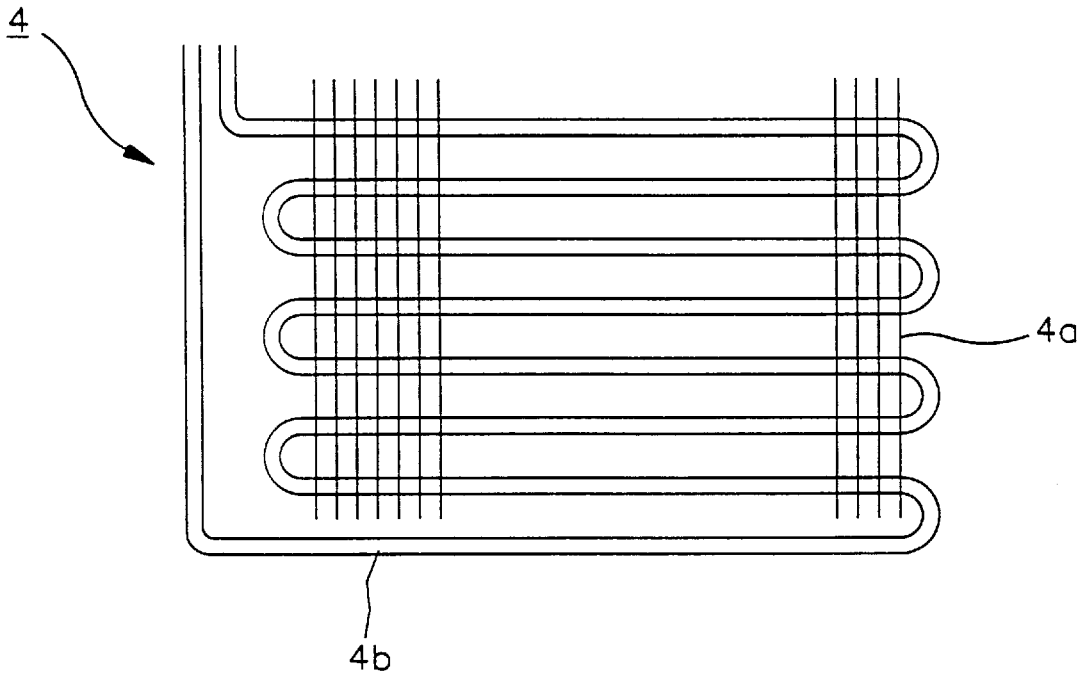
FIG.2 PRIOR ART
FIG. 2 is an enlarged view of the evaporator in the refrigerator shown in FIG. 1.
Figure 3:
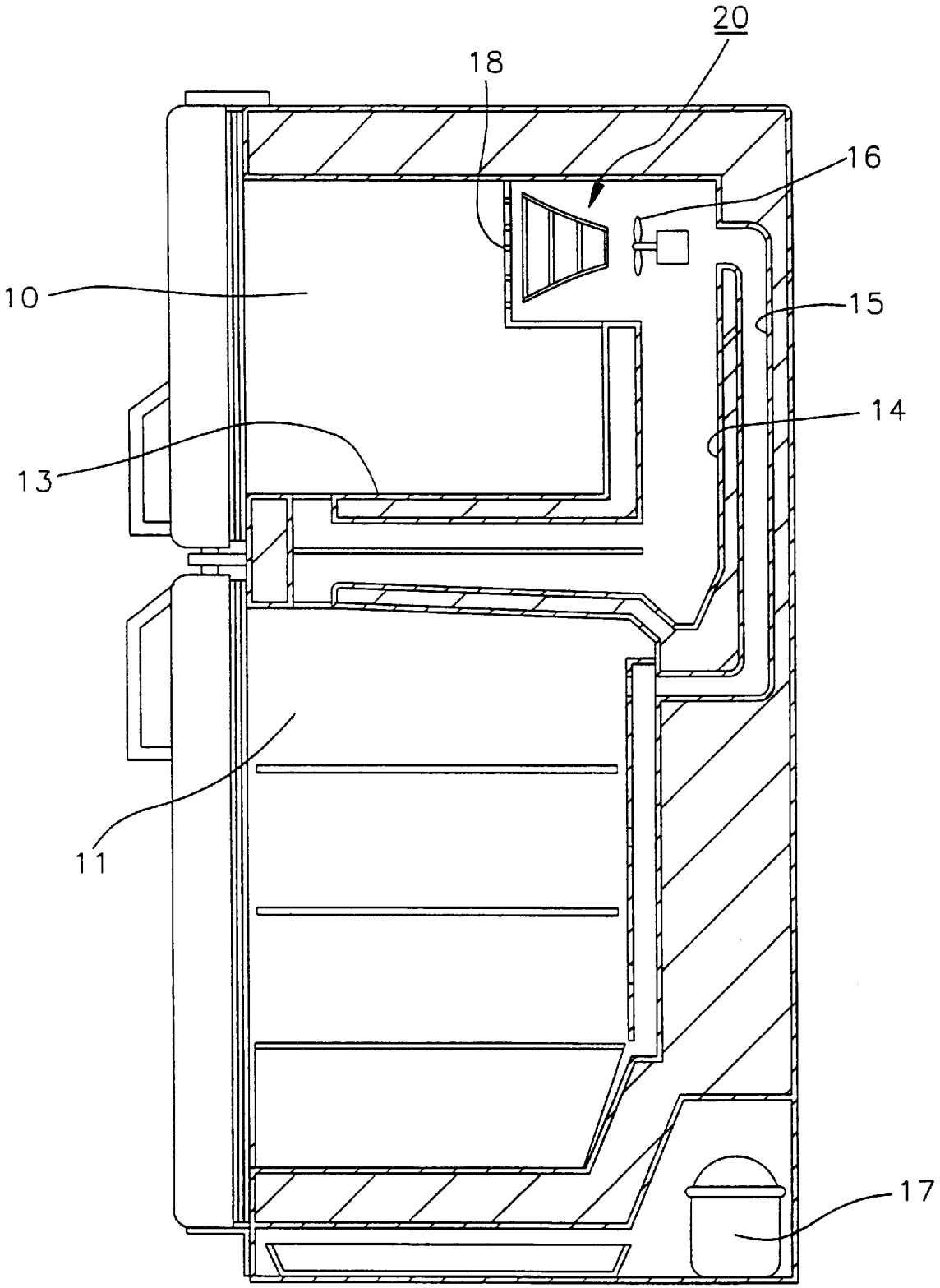
FIG. 3 is a side sectional view of a refrigerator having a cooling apparatus according to an embodiment of the present invention.
Figure 4:
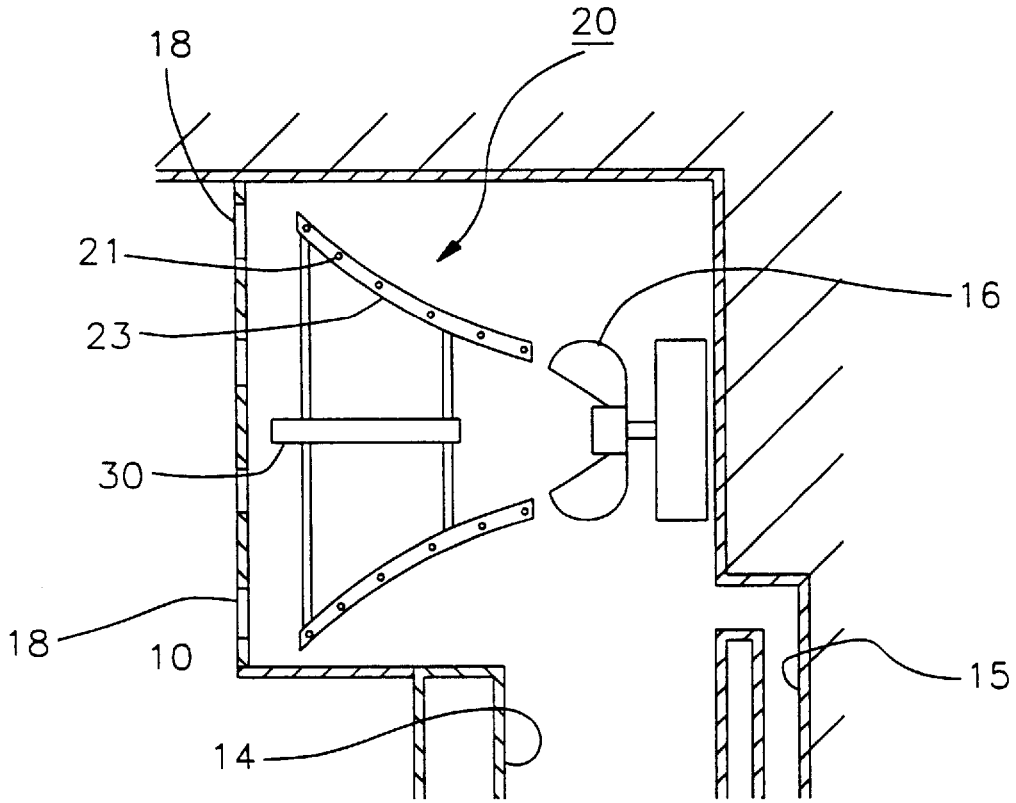
FIG. 4 is an enlarged partial sectional view of FIG. 3.
Figures 5, 5A:
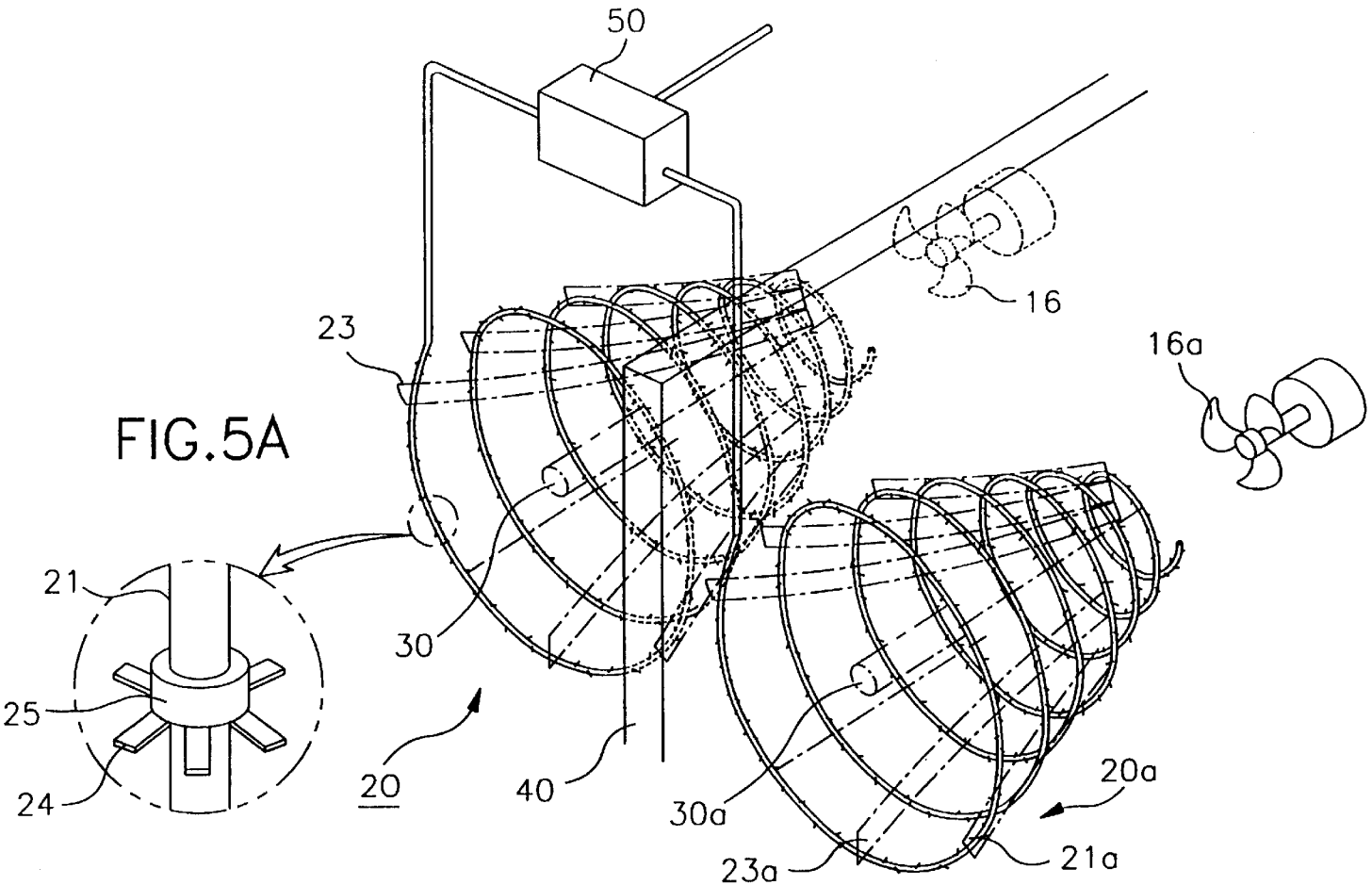
FIG. 5 is a perspective view of the cooling apparatus shown in FIG. 4.
FIG. 5A is an enlarged view of a portion of the cooling apparatus in FIG. 5.

FIG. 3 is a side sectional view of a refrigerator having a cooling apparatus according to the present invention, FIG. 4 is an enlarged partial sectional view of FIG. 3, and FIG. 5 is a perspective view of the cooling apparatus as shown in FIG. 4. FIG. 5A is an enlarged view of a portion of the cooling apparatus in FIG. 5. The refrigerator having the cooling apparatus according to the present invention has, like the conventional refrigerator shown in FIG. 1, a freezing compartment 10 and a fresh food compartment 11 which are separated by a partitioning wall 13. In the back wall of the freezing compartment 10, a cool air duct 14 being communicated with the freezing compartment 10 is disposed in a vertical direction. A pair of evaporators 20, 20*a* are disposed in a cool air duct 14, and a compressor 17 is installed in the lower hind part of the refrigerator. The compressor 17 provides the evaporators 20, 20*a* with the compressed refrigerant thereby through a condenser (not shown) which condenses the compressed refrigerant. Between the condenser and the evaporators 20, 20*a*, a valve device 50 is disposed. The valve device 50 controls the supply of the refrigerant from the condenser to the evaporators 20, 20*a* respectively.

The evaporators 20, 20*a* generate cool air by evaporating the refrigerant. The evaporators 20, 20*a* are disposed transversely to a longitudinal direction of the cool air duct 14. Between the evaporators 20, 20*a*, a partitioning wall 40 is disposed. The partitioning wall 40 separates the evaporators 20, 20*a* from each other. Behind the evaporators 20, 20*a*, a pair of blowing fans 16, 16*a* for blowing toward the evaporators 20, 20*a* are disposed. The cool air blown by the blowing fans 16, 16*a* is provided into the freezing compartment 10 through a plurality of cool air discharging ports 18 formed at an end of the cool air duct 14. In the rear part of the cool air duct 14, a refrigerating duct 15 which is communicated with the fresh food compartment 11 is disposed. Part of the cool air from the evaporators 20, 20*a* is provided into the fresh food compartment 11 through the refrigerating duct 15.

The evaporators 20, 20*a* are disposed at the upper end area of the cool air duct 14 therein to be adjacent to the cool air discharging ports 18 opened toward the freezing compartment 10. The evaporators 20, 20*a* have conductive pipes 21, 21*a* which are wound spirally, a plurality of fin members 25 disposed on the outer surface of the conductive pipes 21, 21*a*, and bracket members 23, 23*a* for supporting the spiral shape of the conductive pipes 21, 21*a*.

The conductive pipes 21, 21*a* are formed so that the diameters of the wound portion thereof are increasing gradually along the circulating direction of the cool air in the cool air duct 14. That is, the conductive pipes 21, 21*a* are wound to have a larger diameter at the front portion which is adjacent to the cool air discharging ports 18 than the diameter at the rear portion which is distant from the cool air discharging ports 18, and accordingly the conductive pipes 21, 21*a* form substantially a cone-shaped space therein. Both ends of one conductive pipe 21 are connected to the condenser and to the compressor 17 respectively, and both ends of the other conductive pipe 21*a* are too.

Fin members 25 are formed to be ring-shaped so as to surround the conductive pipe 21, 21*a*, and the fins 24 are disposed radially on the outer surface of the fin members 25. The fin members 25 are mounted almost on the entire area of the conductive pipes 21, 21*a*. The fin members 25 enlarge the area which is contacted with the ambient air in order to increase the amount of heat exchange therewith.

The bracket members 23, 23*a* have a shape of a bar and are disposed nearly along the blowing direction by the blowing fans 16, 16*a*. The conductive pipes 21, 21*a* are wound so that they may pass through the bracket members 23, 23*a*, and accordingly the conductive pipes 21, 21*a* are kept in spiral cone-shapes. In the cone-shaped spaces formed by the conductive pipes 21, 21*a*, defrosting heaters 30, 30*a* for defrosting said evaporators 20, 20*a* are disposed coaxially with the conductive pipes 21, 21*a*.

Hereinbelow, the function and effect of the refrigerator according to the present invention will be described.

When the refrigerator operates, the compressor 17 begins to compress the refrigerant, and the refrigerant is compressed into gas having high temperature and high pressure. The refrigerant radiates heat in the condenser to become a liquid state, and the liquid state refrigerant is supplied into the evaporators 20, 20*a*. At that time, the supply of the refrigerant into the evaporators 20, 20*a* is controlled by the valve device 50. The valve device 50 supplies the evaporators 20, 20*a* simultaneously or alternatively with the refrigerant. The refrigerant evaporates in the conductive pipes 21, 21*a* of the evaporators 20, 20*a* so as to absorb heat from the ambient air in the cool air duct 7, and accordingly the cool air is generated around the conductive pipes 21, 21*a*. The blowing fans 16, 16*a* provide the cool air into the freezing compartment 10 by blowing toward the evaporators 20, 20*a* respectively. At that time, part of the cool air is provided into the fresh food compartment 11 through the refrigerating duct 15.

The air blown by the blowing fans 16, 16*a* is changed into the cool air by heat exchange with the evaporators 20, 20*a*. The blown air is in contact with substantially the entire areas of the conductive pipes 21, 21*a* all at once, and part of the blown air is rotated by the spiral shapes of the conductive pipes 21, 21*a* with being centered with the axis of the conductive pipes 21, 21*a*. Accordingly, the blown air forms a complex air flow and the air passing through the evaporators 20, 20*a* becomes in contact uniformly with the entire area of the evaporators 20, 20*a* without uneven distribution of the contacted areas, so the heat exchange efficiency is increased. Also, the fins 24 which are protruded radially on the substantially entire outer surface of the conductive pipes 21, 21*a* not only function to enlarge the contacting areas with ambient air but also function to generate more complex air flow, and therefore the heat exchange efficiency is increased more.

Also, since the blown air by the blowing fans 16, 16*a* is in contact uniformly with almost the entire areas of the evaporators 20, 20*a*, the frost is generated uniformly without maldistribution thereon and the period for defrosting operation becomes longer. Accordingly, a lowering of efficiency for cooling operation due to frequent defrosting operation is prevented. Furthermore, since the defrosting heaters 30, 30*a* are disposed coaxially with the conductive pipes 21, 21*a*, the heat generated during the defrosting operation is transferred uniformly to the conductive pipes 21, 21*a*, so the efficiency for defrosting operation is increased.

Moreover, since the conductive pipes 21, 21*a* substantially have cone-shapes, the blown air is dispersed as it passes therethrough. As the evaporators 20, 20*a* are disposed near the cool air discharging ports 18, the cool air is dispersed the moment the cool air is discharged, so it is provided in almost overall area of the freezing compartment 10. Accordingly, the maldistribution in the degree of cooling of freezing compartment 10 does not occur and uniform cooling thereof is possible.

When the frost generated on one of the evaporators 20, 20*a* reaches predetermined amount during the operation of the evaporators 20, 20*a,* the defrosting operation of that evaporator begins. At first, the valve device 50 stops supplying the refrigerant into the evaporator to be defrosted, and at second the defrosting heater corresponding to that evaporator begins to operates. At that time, the supply of the refrigerant into the other evaporator is continued, so the providing of the cool air into the freezing compartment 10 and the fresh food compartment 11 is continued. When the defrosting of the evaporator is completed, the valve device 50 begins again to provide to that evaporator, and the cooling operation by two evaporators 20, 20*a* begins again. During such an operation, the blowing fan which corresponds to the evaporator of which the supply of the refrigerant is cut off stops operating. The partitioning wall 40 disposed between the evaporators 20, 20*a* separates the evaporators 20, 20*a* in space so as to prevent the lowering of the cooling efficiency of one evaporator which may be occurred by the heat generated by the defrosting heater during the defrosting operation of the other evaporator. As described, since it is possible to defrost the only one evaporator which requires defrosting operation during the cooling operation of the other evaporator, the overall cooling operation is executed continuously and thus the cooling efficiency is increased.

Although, in this embodiment, the evaporators 20, 20*a* are operated simultaneously and the only evaporator that requires defrosting operation stops operating, it is possible to operate each evaporator alternately. That is, by supplying the refrigerant to the evaporators 20, 20*a* alternatively and alternately, one evaporator is being defrosted or stops operating while the other evaporator is being operated, and if the other evaporator which has been operated requires defrosting, said one evaporator begins to operate. Accordingly, the cooling intensity by the evaporators 20, 20*a* are continuously kept even. In that situation, the blowing fans 16, 16*a* are controlled so that only one blowing fan corresponding to the evaporator which is being supplied with the refrigerant may be operated. Furthermore, in that situation, if a user wants even stronger cooling, it is preferable to operate the two evaporators 20, 20*a* simultaneously.

It is possible to adopt more than three evaporators and control them respectively or serially.

As described above, according to the present invention, the cooling apparatus having high efficiency of cooling by a plurality of evaporators which is possible to be controlled respectively is provided. Also, uniform cooling can be achieved as the heat exchange of the evaporators with ambient air is carried out efficiently by the conductive pipes which are spirally wound to have a cone-shape. Furthermore, since the frost is generated uniformly on the entire areas of the evaporators without maldistribution, the period for defrosting operation becomes longer so that the cooling efficiency is improved more, and specifically the efficiency for defrosting operation is improved by the defrosting heaters which provide heat for defrosting evenly over the entire areas of the conductive pipes.

Although the present invention has been described and illustrated in detail, it is clearly understood that the same is by way of illustration and example only and is not to be taken by way of limitation wherein the spirit and scope of the present invention is limited only by the terms of the appended claims.

What is claimed is:

1. A refrigerator having a cooling apparatus which includes a cool air duct disposed in a wall of a cooling compartment and which is communicated with said cooling compartment, said cooling apparatus comprising:

a plurality of evaporators disposed transversely to a longitudinal direction of said cool air duct therein for generating cool air, said plurality of evaporators being conductive pipes respectively, said conductive pipes being wound spirally along the longitudinal direction of said cool air duct, and a plurality of fins being mounted for heat exchange along outer surfaces of said conductive pipes;

a means for controlling a supply of refrigerant to said evaporators respectively; and a plurality of blowers for blowing toward said evaporators respectively to provide said cooling compartment with the cool air.

2. The refrigerator having a cooling apparatus as claimed in claim 1, wherein a diameter of a wound part of said conductive pipes increases gradually along a blowing direction of said blowers.

3. The refrigerator having a cooling apparatus as claimed in claim 1, further comprising a plurality of heaters for defrosting said evaporators respectively, said heaters being disposed coaxially with said conductive pipes respectively in cone-shaped spaces formed by said conductive pipes.

4. The refrigerator having a cooling apparatus as claimed in claim 1, further comprising a plurality of walls for partitioning said evaporators.

5. The refrigerator having a cooling apparatus as claimed in claim 1, wherein the number of said evaporators is two.

6. The refrigerator having a cooling apparatus as claimed in claim 1, wherein said controlling means is controlled to alternatively supply said evaporators with the refrigerant.

7. The refrigerator having a cooling apparatus as claimed in claim 2, wherein said evaporators are disposed in an area adjacent to cool air discharging ports of said cool air duct which are opened toward said cooling compartment.

8. A refrigerator having a cooling apparatus which includes a cool air duct disposed in a wall of a cooling compartment and which is communicated with said cooling compartment, said cooling apparatus comprising:

a plurality of evaporators disposed transversely to a longitudinal direction of said cool air duct therein for generating cool air, said evaporators having conductive pipes respectively which are wound spirally along a longitudinal direction of said cool air duct and a plurality of fins for exchanging heat which are mounted on outer surfaces of said conductive pipes;

a plurality of walls for partitioning said evaporators;

a means for controlling a supply of refrigerant to said evaporators respectively;

a plurality of blowers for blowing toward said evaporators respectively to provide said cooling compartment with the cool air; and a plurality of heaters for defrosting said evaporators respectively, said heaters being disposed coaxially with said conductive pipes respectively in cone-shaped spaces formed by said conductive pipes.

* * * * *